US005151562A

United States Patent [19]

Fujita et al.

[11] Patent Number: 5,151,562

[45] Date of Patent: Sep. 29, 1992

[54] SYSTEM FOR ADJUSTING HORIZONTAL DEVIATIONS OF AN ELEVATOR CAR DURING VERTICAL TRAVEL

[75] Inventors: Akira Fujita; Hisao Kato, both of Aichi, Japan

[73] Assignee: Mitsubishi Denki Kabushiki Kaisha, Japan

[21] Appl. No.: 714,023

[22] Filed: Jun. 12, 1991

[30] Foreign Application Priority Data

Jun. 18, 1990 [JP] Japan ..... 2-157474
Jan. 25, 1991 [JP] Japan ..... 3-47213

[51] Int. Cl.[5] ..... B66B 3/02
[52] U.S. Cl. ..... 187/134
[58] Field of Search ..... 187/95; 364/191, 513

[56] References Cited

U.S. PATENT DOCUMENTS 4,507,738 3/1985 Nozawa et al. ..... 364/513
4,617,502 10/1986 Sakaue et al. ..... 364/191
4,750,590 6/1988 Otala ..... 187/95

*Primary Examiner*—A. D. Pellinen
*Assistant Examiner*—Lawrence E. Colbert
*Attorney, Agent, or Firm*—Leydig, Voit & Mayer

[57] ABSTRACT

A system for reducing horizontal deviations of elevators in which a cage ascends or descends in an ascending/decending path while engaged with guide rails through guide shoes is provided. The system includes a displacement device, disposed between the cage and the guide shoes, for displacing the cage relative to the guide rails in a horizontal direction. A position detecting device is provided for detecting a position of the cage in an ascending/descending direction, storage device for storing error data corresponding to guide rail installation errors with respect to positions of the cage in the ascending/descending direction and control device for controlling the displacement device to correct positional deviations of the cage in the horizontal direction resulting from the guide rail installation errors in accordance with the error data stored in the storage device, the error data corresponding to the position detected by the position detecting device.

9 Claims, 7 Drawing Sheets

SYSTEM FOR ADJUSTING HORIZONTAL DEVIATIONS OF AN ELEVATOR CAR DURING VERTICAL TRAVEL

BACKGROUND OF THE INVENTION

This invention relates to an elevator in which a cage ascends or descends within an ascending/descending path while guided by guide rails arranged along the ascending/descending path. More particularly, it is directed to an elevator which can be installed within a short period of time and which can prevent its cage from being oscillated horizontally.

In the installation of the guide rails, which serve to guide the cage, onto the inner surface of the ascending-/descending path, it has conventionally been necessary to adjust the position, distance, and straightness of the right and left guide rails, i.e., "align" the guide rails as disclosed in, e.g., Japanese Unexamined Publication No. 39512/1989. Thus, in the installation of a conventional elevator, a comparatively large part of the overall installation time is expended for the installation and, particularly, alignment of the guide rails.

In such conventional elevator, the alignment of the guide rails is time-consuming, which makes the installation of the elevator itself likewise time-consuming. Further, it is difficult to increase alignment accuracy, and as a result, the cage is left more susceptible to horizontal oscillation while the elevator is ascending or descending, causing an unpleasant ride Particularly, in an elevator whose travelling course is as long as several hundred meters demanding an accurate alignment which is more difficult; it takes time to install its guide rails and their alignment is not accurate.

SUMMARY OF THE INVENTION

This invention has been made to overcome the above problems. Accordingly, an object of the invention is to provide an elevator which is capable of significantly reducing the time required for installing guide rails and to thereby shorten its entire installation time.

A further object of the invention is to prevent the elevator from being oscillated horizontally, thereby providing a comfortable ride.

A first aspect of the invention is applied to an elevator, which includes: a displacement mechanism for displacing a cage relative to guide rails in a horizontal direction, the displacement mechanism being disposed between the cage and guide shoes; a detector for detecting a position of the cage in an ascending/descending direction; storage means for storing error data relating to guide rail installation errors with respect to positions of the cage in the ascending/descending direction; and a controller for controlling the displacement mechanism in accordance with the error data from the position detector and the storage means.

A second aspect of the invention is applied to an elevator which includes: a displacement mechanism for displacing a cage relative to the guide rails in a horizontal direction, the displacement mechanism being disposed between the cage and guide shoes; a detector for detecting a position of the cage in an ascending/descending direction; storage means for storing error data relating to guide rail installation errors with respect to positions of the cage in the ascending/descending direction; a detector for detecting operational states of the cage. Both detectors are connected to a controller. The controller not only calculates an estimated position of the cage from data from these detectors, but also controls the displacement mechanism in accordance with data from the storage means, the data corresponding to the estimated position of the cage.

A third aspect of the invention is applied to an elevator which includes: a displacement mechanism for displacing a cage relative to guide rails in a horizontal direction, the displacement mechanism being disposed between the cage and guide shoes; a detector for detecting a position of the cage in an ascending/descending direction; storage means for storing error data about guide rail installation errors with respect to positions of the cage in the ascending/descending direction; a detector for detecting operational states of the cage. Both detectors are connected to a controller, and the controller is connected to a unit for driving the cage so that the controller can decelerate the cage. The controller also calculates an estimated position of the cage based on data from these detectors, and controls the displacement mechanism in accordance with the error data from the storage means, the data corresponding to the estimated position of the cage.

A fourth aspect of the invention is applied to an elevator which includes: a displacement mechanism for displacing a cage relative to guide rails in a horizontal direction, the displacement mechanism being disposed between the cage and guide shoes; positional deviations detecting means for detecting positional deviations of the cage in the horizontal direction resulting from guide rail installation errors, the positional deviation detecting means being disposed within the ascending/descending path. A controller for controlling the displacement mechanism in accordance with position deviation data from the positional deviation detecting means is connected to both the positional deviation detecting means and the displacement mechanism.

According to the first aspect of the invention, the positional deviations of the cage resulting from the guide rail installation errors are corrected by controlling the displacement mechanism by the controller in accordance with error data in the storage means; the error data corresponding to the detected position of the cage in the ascending/descending direction detected by the position detector.

According to the second aspect of the invention, the positional deviations of the cage resulting from the guide rail installation errors are corrected by controlling the displacement mechanism by the controller in accordance with error data in the storage means, the error data corresponding to an estimated position calculated by the controller. The estimated position is a position that the cage will reach after, predetermined time. It is calculated using detection data which includes the position of the cage detected by the position detector and its operational states detected by the operational state detector.

According to the third aspect of the invention, the positional deviations of the cage resulting from the guide rail installation errors are corrected by controlling the displacement mechanism by the controller in accordance with error data in the storage means, the error data corresponding to an estimated position calculated by the controller. The estimated position is a position that the cage will reach after a predetermined time. It is calculated using detection data includes the position of the cage detected by the position detector and its operational states detected by the operational state detector. In addition, when the rate of change at the estimated position is larger than a predetermined value, the controller decelerates the cage.

According to the fourth aspect of the invention, the positional deviations of the cage resulting from the guide rail installation errors are corrected by causing the controller to control the displacement mechanism in accordance with the data corresponding to the positional deviations of the cage detected by the positional deviation detecting means.

DETAILED DESCRIPTION OF THE PREFERRED EMBODIMENT

The present invention will now be described in more detail with reference to the accompanying drawings. One example of an elevator according to the present invention will be described.

Figure 1:
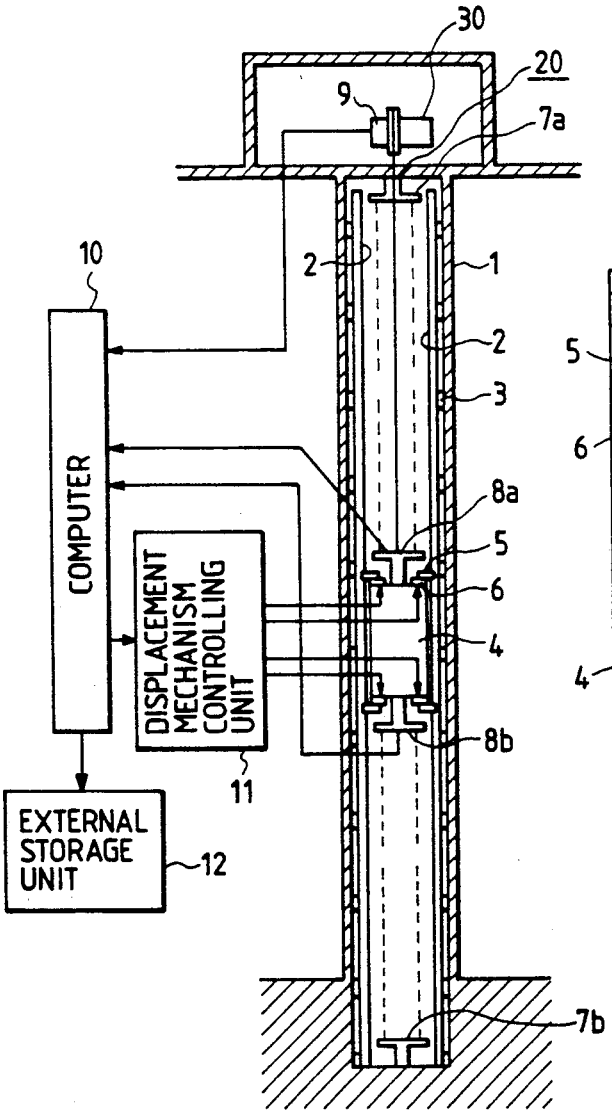
FIG. 1 is a block diagram showing an elevator of first embodiment of the invention.
Figure 2:
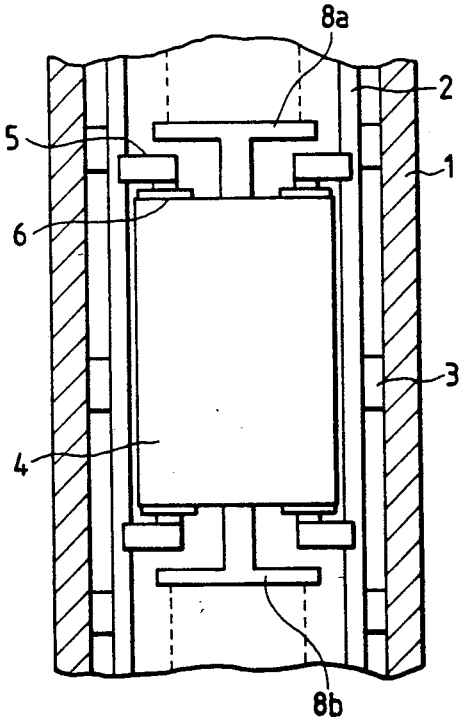
FIG. 2 is a enlarged view showing a cage in FIG. 1.

FIG. 1 is a block diagram showing the state of the elevator at the time of its installation; and FIG. 2 is a diagram showing a cage of FIG. 1 in an enlarged form.

In FIGS. 1 and 2, a pair of guide rails 2 are installed on the inner wall surface of an ascending/descending path 1 through rail brackets 3, the guide rails being roughly aligned. Inside the ascending/descending path 1 is a cage 4 arranged so as to ascend and descend while guided by the guide rails 2. At both top and bottom ends of the cage 4 are guide shoes 5 arranged so as to be engaged with the guide rails through displacement mechanisms 6, respectively.

Figure 3:
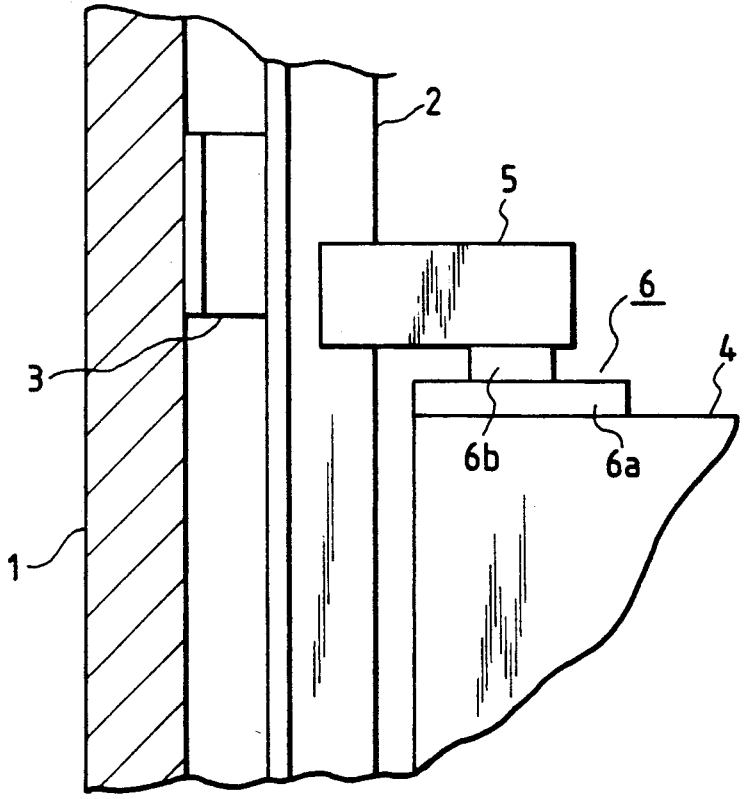
FIG. 3 is a front view showing a main portion of FIG. 1.
Figure 4:
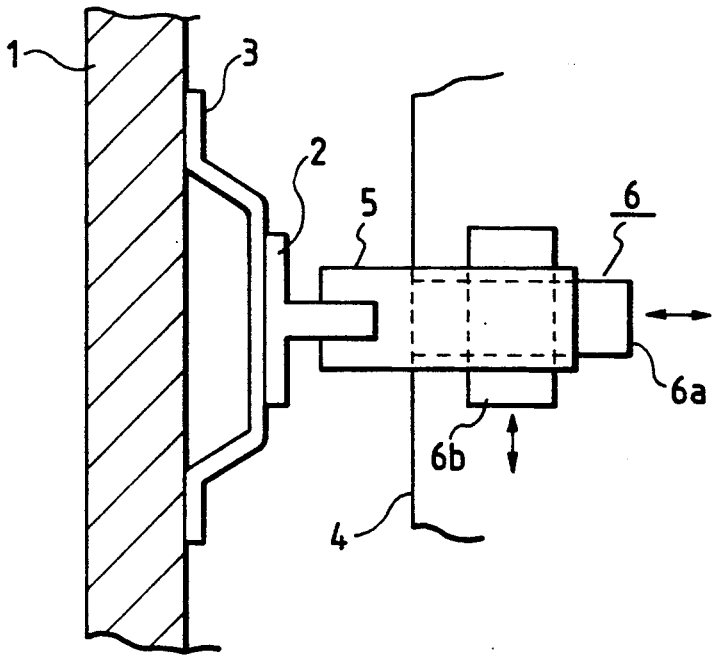
FIG. 4 is a plan view of FIG. 3.

FIG. 3 is a front view showing a main portion of FIG. 2 in an enlarged form; and FIG. 4 is a plan view of FIG. 3. As shown in FIGS. 3 and 4, the displacement mechanism 6 consists of an X-direction displacement mechanism 6*a* and a Y-direction displacement mechanism 6*b*. The X-direction displacement mechanism 6*a* causes the cage 4 to move perpendicular to the wall surface of the ascending/descending path 1, while the Y-direction displacement mechanism 6*b* causes the cage 4 to move in parallel therewith.

In FIG. 1, at the uppermost portion of the ascending-/descending path 1 is a first light-emitting device 7*a* which emits at least two laser beams (shown by broken lines in FIG. 1) to the cage 4. On a ceiling portion of the cage 4 is a first light-receiving device 8*a* which receives the laser beams from the first light-emitting device 7*a*. At the bottommost portion of the ascending/descending path 1 is a second light-emitting device 7*b* which emits at least two laser beams to the cage 4. At a lower end portion of the cage 4 is a second light-receiving device 8*b* which receives the laser beams from the second light-emitting device 7*b*. The path of each laser beam is oriented so as to go along an ideal ascending or descending course of travel of the cage 4, e.g., along the vertical line. At an upper portion o the ascending/descending path 1 is a position detector 9 which detects the position of the cage 4 in its ascending/descending direction. This position detector 9 is mounted on a hoisting machine 30. The light-emitting devices 7*a*, 7*b* and the light-receiving devices 8*a*, 8*b* will be removed after the installation work has been completed.

Each of the first and second light-receiving devices 8*a*, 8*b* and the position detector 9 are connected to a computer 10. The displacement mechanism 6 is connected to the computer 10 through a displacement mechanism controlling unit 11 which controls the driving of the displacement mechanism 6. An external storage unit 12 is also connected to the computer 10 as a storage means.

The elevator thus constructed is first subjected to a trial run at a low speed in the state shown in FIG. 1. When data about the laser beam irradiation positions on the respective light-receiving devices 8*a*, 8*b* are applied to the computer 10, deviations of the applied irradiation positions on the respective light-receiving devices 8*a*, 8*b* from predetermined values, i.e., deviations of the cage 4 in the horizontal direction derived from guide rail 2 and other installation errors committed during rough alignment, are calculated. Then, data for correcting the calculated deviations are applied from the computer 10 to the displacement mechanism controlling unit 11. The displacement mechanism controlling unit 11 controls the displacement mechanism 6 in accordance with the data from the computer 10 and causes the cage 4 to be displaced relative to the guide rails 2, so that the laser beams from the respective light-emitting devices 7*a*, 7*b* can be irradiated onto the predetermined positions at any given time.

In the meantime, the position (height) of the cage 4 in the ascending/descending direction is detected by the position detector 9 at all times, and the detected data is applied to the computer 10. Data which is a combination of the data from the position detector 9 and the data relating to the displacement of the displacement mechanism 6, i.e., data relating to the guide rail 2 installation errors relative to the position of the cage 4 in the ascending/descending direction (hereinafter referred to as "error data") is applied from the computer 10 to the external storage unit 12 to be stored therein. Once error data on the entire ascending/descending course have been applied to the external storage unit 12 and stored therein, the respective light-emitting devices 7*a*, 7*b* and light-receiving devices 8*a*, 8*b* are removed to complete the installation work.

Figure 5:
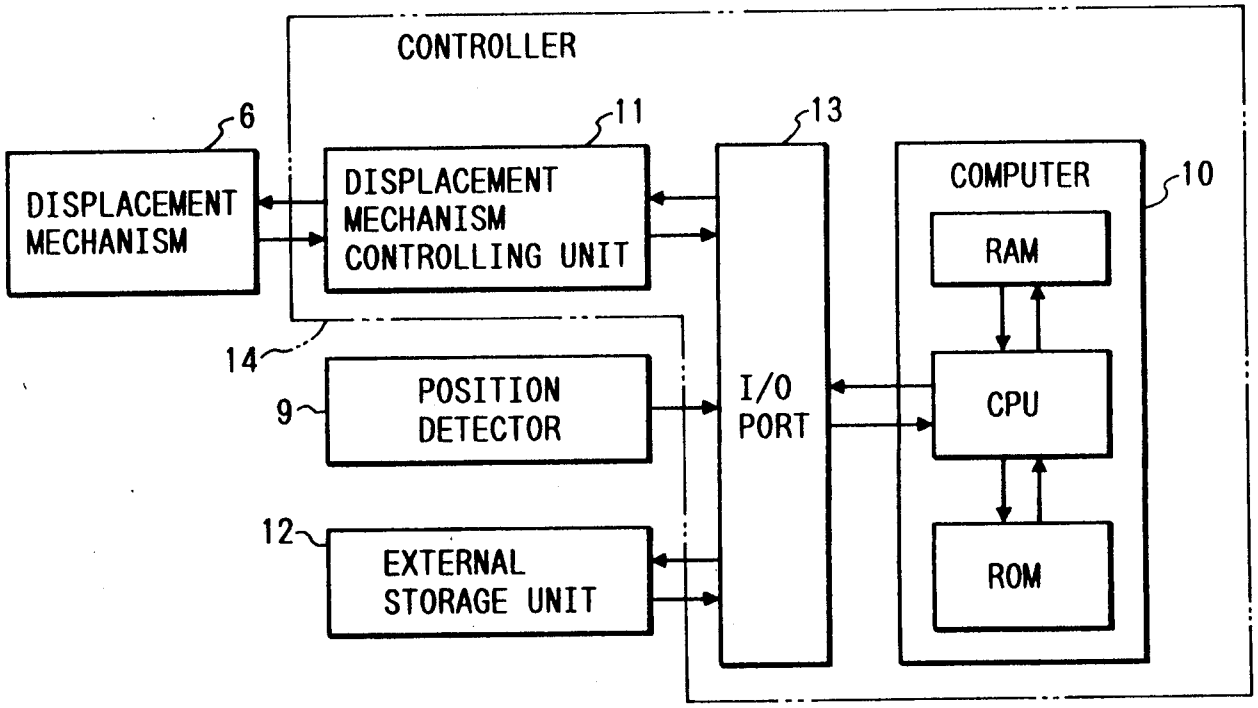
FIG. 5 is a block diagram showing the elevator shown in FIG. 1 when operated.

FIG. 5 is a block diagram showing the elevator of FIG. 1 at the time of its normal operation.

In FIG. 5, each of the displacement mechanism controlling unit 11, the position detector 9, and the external storage unit 12 is connected to a CPU (central processing unit) of the computer 10 through an I/0 (input/output) port 13 (omitted in FIG. 1). The computer 10, the displacement mechanism controlling unit 11, and the I/0 port 13 constitute a controller 14.

To operate the thus constructed elevator under normal conditions, the position of the cage 4 in the ascending/descending direction is detected by the position detector 9 at all times, and the detected data is sent to the computer 10. As a result, a signal is applied from the computer 10 to the external storage unit 12 to apply the error data stored at the time of a trial run to the computer 10. The data is then sent to the displacement mechanism controlling unit 11 so as to cause the displacement mechanism 6 to be controlled thereby. Any positional deviation of the cage 4 derived from guide rail 2 installation errors is corrected at all times by effecting such control at a speed corresponding to the ascending/descending speed of the cage 4. Owing to such correction, the cage 4 can travel vertically without being subjected to horizontal oscillation even with the guide rails 2 being aligned only roughly. Thus, a pleasant ride can be ensured. This contributes not only to simplifying the work of installing the guide rails 2 but to significantly saving the entire installation time as well.

However, elevators whose ascending or descending course is very long ascend and descend at a comparatively high speed, and if a displacement operation takes time to be completed after its instruction, the position of the cage 4 deviates during such operation, thereby not allowing positional corrections to be made in time and thus failing to prevent the horizontal oscillation of the cage 4. When the ascending/descending speed of the cage 4 is increased and the rate of change in the displacement mechanism 6 is increased as well, the displacement mechanism 6 cannot correct the deviations in time, thus making the ride uncomfortable.

Second and third embodiments of the present invention to be described hereinbelow provide certain advantages over the foregoing structure.

Figure 6:
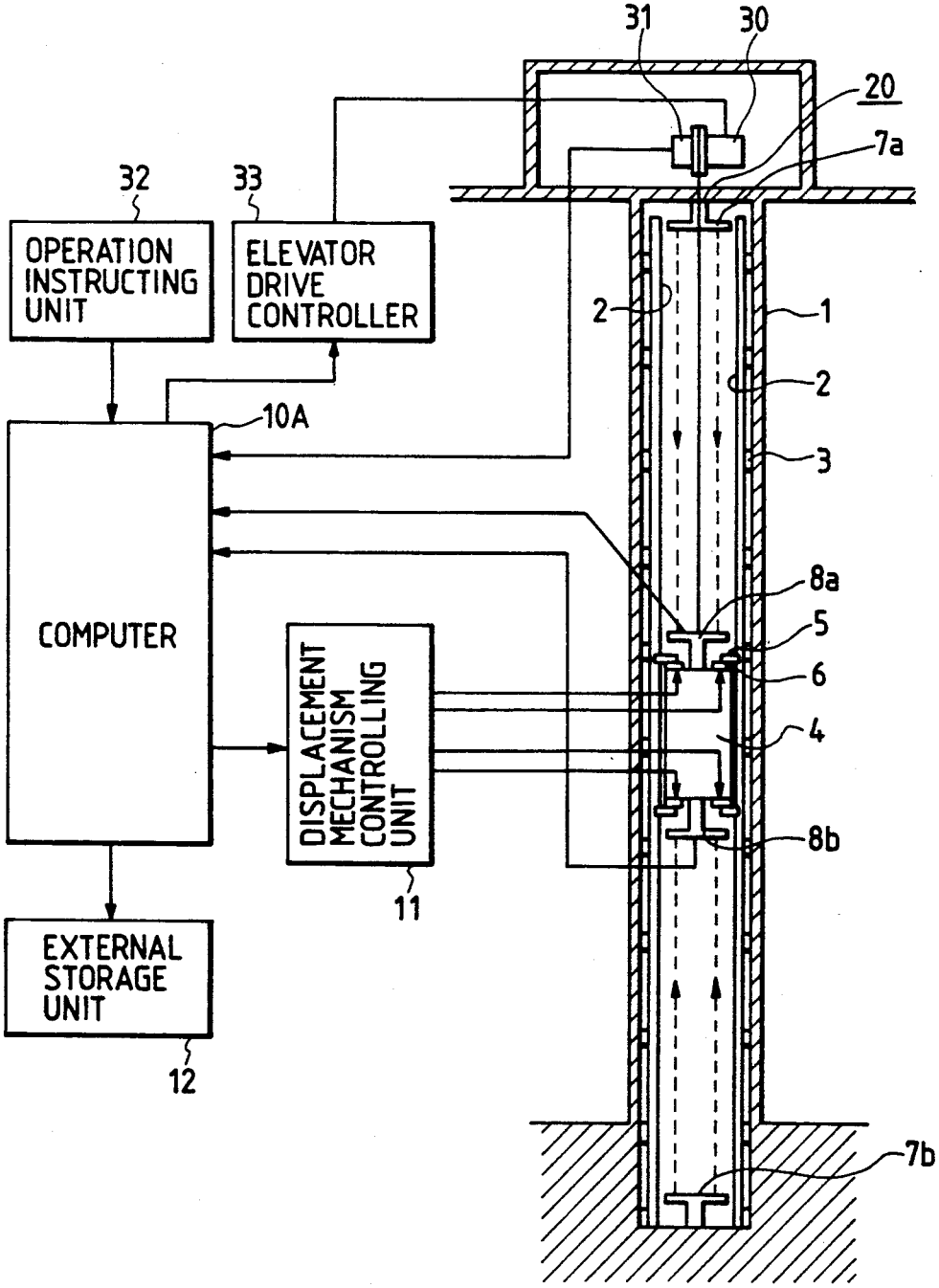
FIG. 6 is a block diagram showing an elevator of second and third embodiments of the present invention.

FIG. 6 is a block diagram showing the elevator at the time of its installation. In FIG. 6, same reference numerals as in FIG. 1 designate same or like parts and components, and the descriptions thereof will thus be omitted.

In FIG. 6, the hoisting machine 30 is provided with an operational state detector 31 including an encoder and the like. The operational state detector 31 serves to detect the position and operational states (direction, speed, and acceleration) of the cage 4, thus serving also as the position detector. Each of first and second light-receiving devices 8*a*, 8*b* and the operational state detector 31 is connected to a computer 10A. The displacement mechanism 6 is also connected to the computer 10A through a displacement mechanism controlling unit 11. An external storage unit 12 serving as a storage means is also connected to the computer 10A. An elevator operation instructing unit 32 is connected to the hoisting machine 30 through the computer 10A and a drive controller 33.

Figure 7:
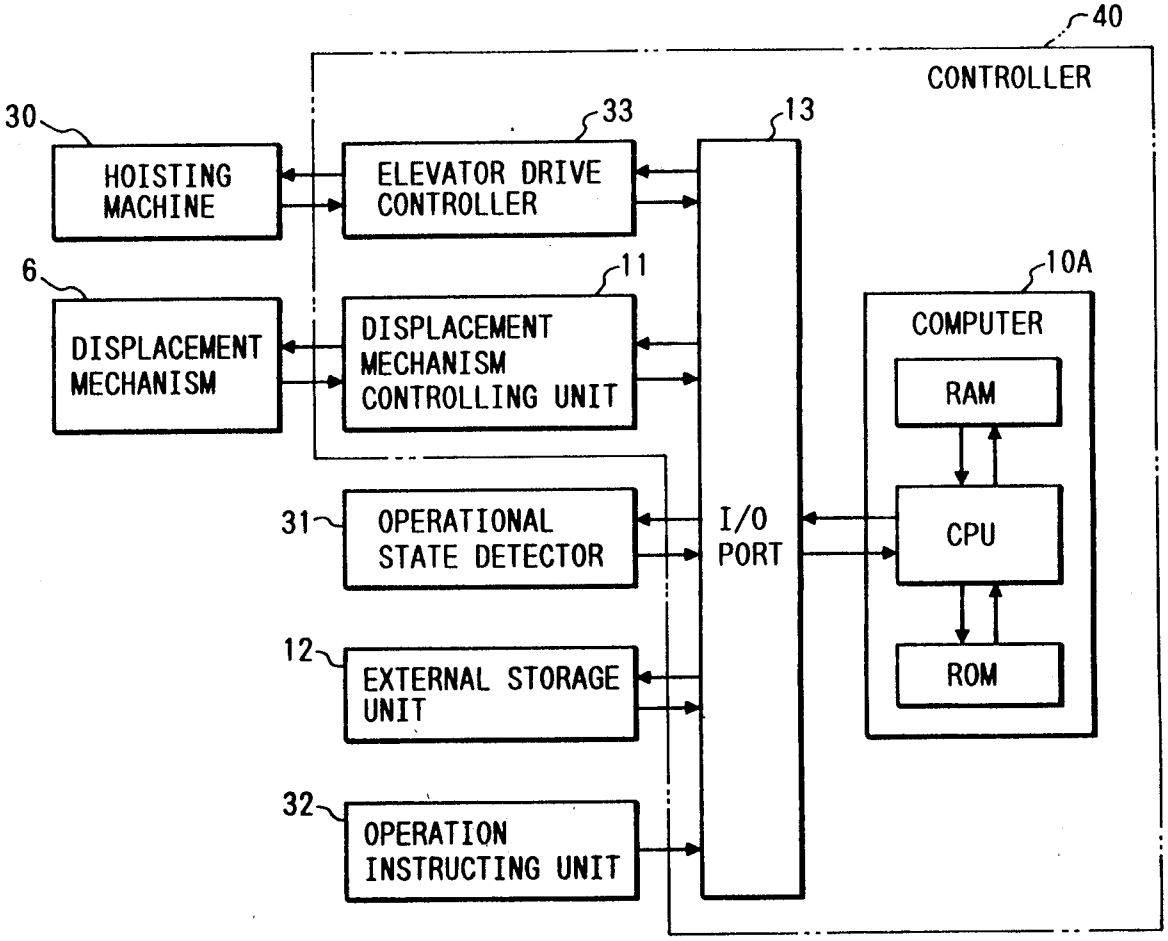
FIG. 7 is a block diagram showing the elevator shown in FIG. 6.

In a manner similar to that of FIG. 1, the thus constructed elevator is subjected to a trial run at a low speed under the state shown in FIG. 5 and error data is stored in the external storage unit 12. During the normal operation, the light-emitting devices 7*a*, 7*b* and light-receiving devices 8*a*, 8*b* are removed. FIG. 7 is a block diagram showing the state of the elevator shown in FIG. 6 when the elevator is in normal operation. A controller 40 consists of the computer 10A, a displacement mechanism controlling unit 11, an I/O port 13, and the drive controller 33.

Figure 8:
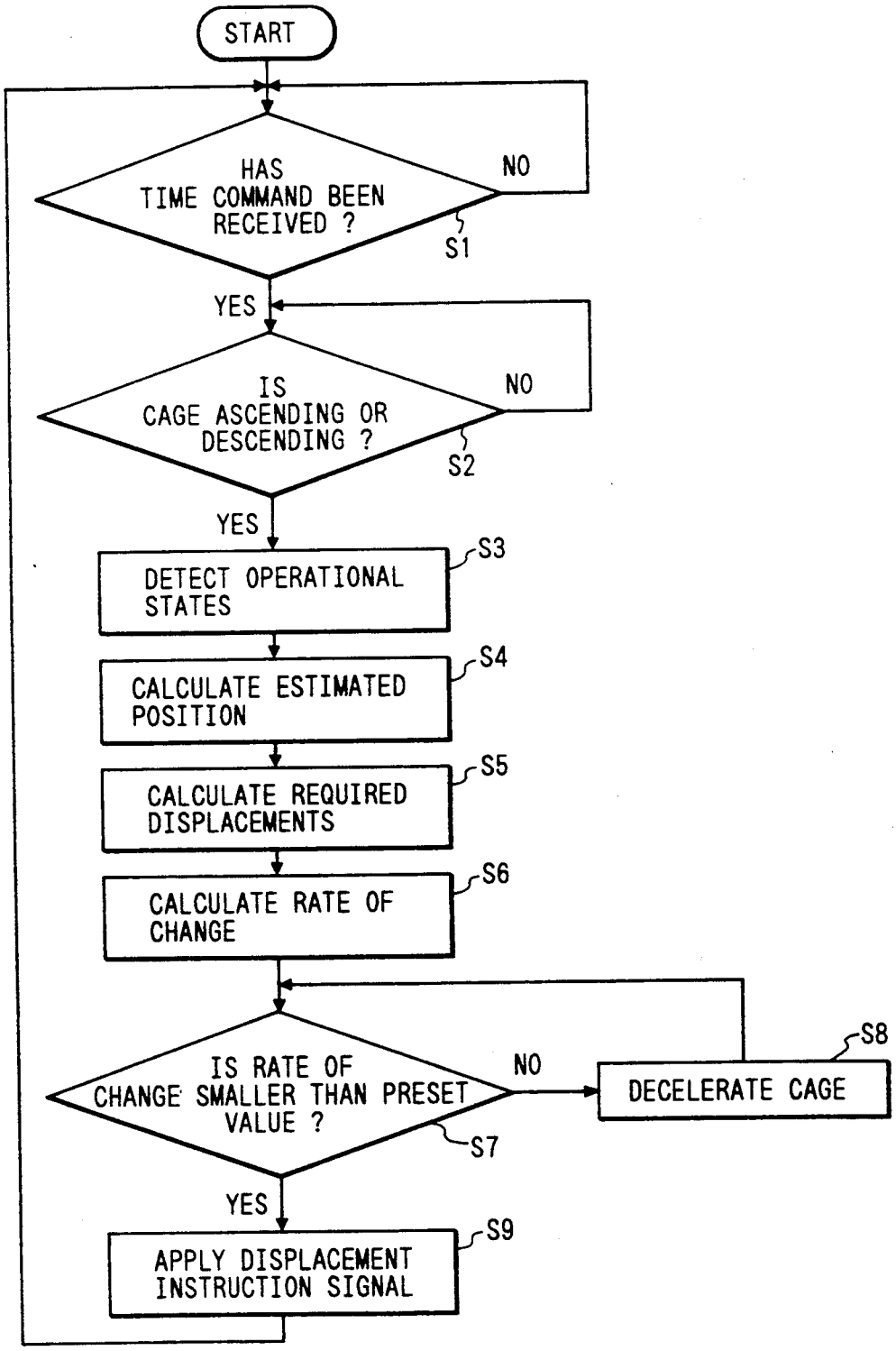
FIG. 8 is a flow chart showing a method of controlling the operation of an elevator using a controller.

A method of controlling the elevator, which is the second and third embodiments of the present invention, will be described with reference to a flow chart shown in FIG. 8. A time T (in seconds), which is an interval of time from an instruction signal application timing to a displacement completion timing, is calculated in advance. Such time T must correspond to a time in which the displacement mechanism 6 is being operated at its full capacity to displace the cage by the largest among the displacement values obtained from the lowspeed trial run. A time command for confirming the positional deviation of the cage 4 is issued every time t (e.g., T/10 second) which is a time sufficiently smaller than T seconds.

From such state, the issuance of the time command is judged (Step S1), and if there has been such issuance, it is judged whether the cage 4 is ascending or descending (Step S2). Therefore, if a time command signal has been applied to the computer 10A and the cage 4 is ascending or descending at that moment, then the operational state of the cage 4 is detected by the operational state detector 31. Accordingly, the position, speed, direction, and acceleration of the cage 4 are calculated by the computer 10A, and then an estimated position where the cage 4 will reach after a predetermined time T (second) is calculated (Step S4). The error data at the estimated position is read from the external storage unit 12 thereby to allow required displacements to be calculated (Step S5).

If, at this moment, the rate of change in the displacement mechanism 6, i.e., displacement of the displacement mechanism 6 relative to the time required for ascending or descending by a unit distance (e.g., 1 m) is increased due to each guide rail 2 being heavily bent locally, then the displacement mechanism 6 is operated with some delay in correcting the deviation, thereby making the ride unpleasant. To overcome this inconvenience, a limit to the change of rate is preset in the computer 10A as a reference value. When the required displacements have been calculated in Step S5, a rate of change at the estimated position is calculated from both the speed of the cage 4 and the unit distance (Step S6), so that whether or not the rate of change is smaller than the preset value can be judged (Step S7). If the rate of change is larger than the preset value, the cage 4 is decelerated by the computer 10A through the drive controlling unit 33 (Step S8). As a result, it takes more time for the cage 4 to ascend or descend by the unit distance, thereby reducing the rate of change. Thus, the correction can be made properly by the displacement mechanism 6, preventing the ride from being uncomfortable.

The deceleration of the cage 4 in Step S8 is implemented, e.g., at a predetermined pitch until it is judged that the rate of change is equal to or smaller than the preset value. Instead, the cage 4 may be decelerated only by a required value in accordance with the rate of change.

If the rate of change is smaller than the preset value, a signal is applied to the displacement mechanism controlling unit 11 directly (Step S9), the displacement mechanism controlling unit 11 causes the displacement mechanism 6 to displace the cage 4 so that the displacement can be completed at the time the cage 4 reaches the estimated position. Such displacement is implemented at a high speed when large, or at a low speed when small.

An elevator, which is fourth embodiment of the present aspect of the invention, will be described. In this embodiment, a position detector 9 and an external storage unit 12 in FIG. 1 are omitted, and positional deviation detecting means 20 is formed of light-emitting devices 7*a*, 7*b* and light-receiving devices 8*a*, 8*b*.

In such elevator, a positional deviation of a cage 4 in the horizontal direction caused by guide rail 2 installation errors is detected by the positional deviation detecting means 20 during the ascending or descending of the cage 4 as shown in FIG. 1, and the detected data is applied to a computer 10. In response thereto, an instruction for correcting such positional deviation is applied from the computer 10 to the displacement mechanism controlling unit 11. Upon reception of the instruction, the displacement mechanism controlling unit 11 drives the displacement mechanism 6 to displace the cage 4 to compensate for the positional deviation. Accordingly, the horizontal oscillation of the cage 4 caused by the guide rail 2 installation errors can be corrected on a realtime basis at all times. It should be noted that each of the displacement mechanism 6, the controller 14, and the like requires a processing speed commensurate with the ascending/descending speed of the cage 4.

Therefore, similar to the first embodiment of the present invention, the time for installing the guide rails 2 is significantly reduced, which not only reduces the overall installation time, but also prevents horizontal oscillation of the cage 4, thereby ensuring a comfortable ride in the elevator. In addition, the cage 4 can ascend or descend without horizontal oscillation even in the presence of the deformation of the guide rails 2 or the like caused after the installation.

While the displacement mechanism 6 consisting of the X-direction displacement component 6*a* and the Y-direction displacement component 6*b* has been described in the above embodiments, the application of the invention is not limited thereto; the displacement mechanism may be formed of other means as long as the cage 4 can be displaced horizontally.

Figure 9:
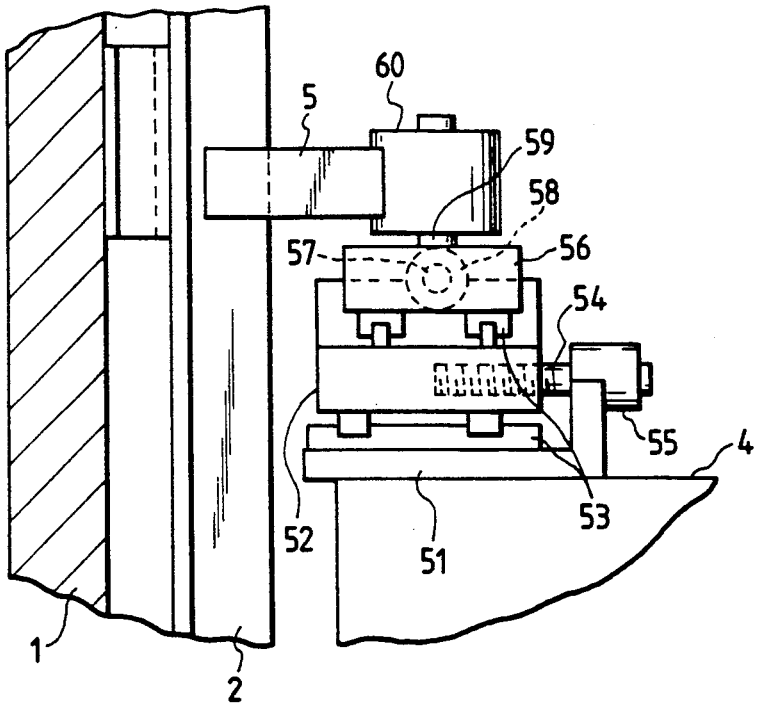
FIG. 9 is a side view showing a displacement mechanism of the first or fourth embodiment of the present invention.
Figure 10:
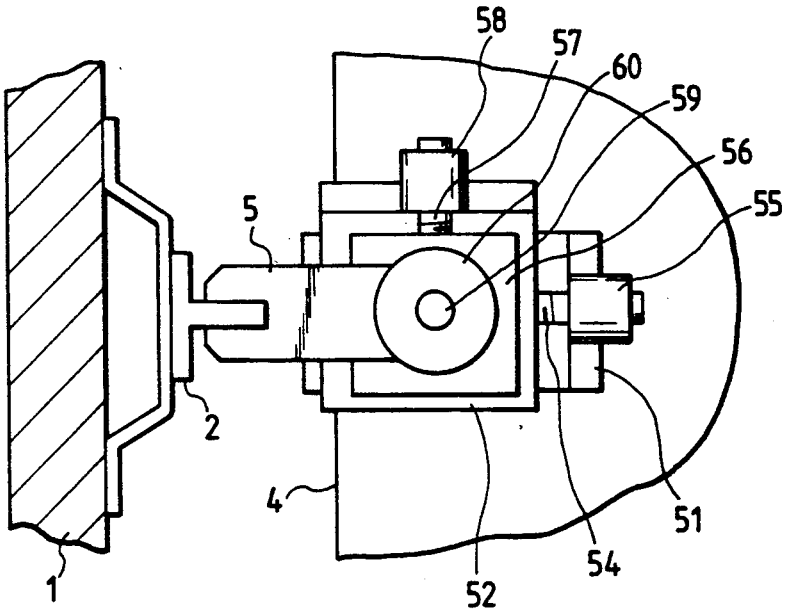
FIG. 10 is a plan view of FIG. 9.

For example, FIG. 9 is a side view showing another displacement mechanism; and FIG. 10 is a plan view of FIG. 9. In FIGS. 9 and 10, a base 51 is secured to an upper portion of the cage 4. On the base 51 is an X-direction moving stand 52 arranged so as to be slidable in the X-direction (from right to left and vice versa as viewed from FIGS. 9 and 10) through linear guides 53. An X-direction drive unit 55 is secured to the base 51. The X-direction drive unit 55 serves to rotate an X-direction drive screw 54, which extends in the X-direction and is screwed into the X-direction moving stand 52. The X-direction moving stand 52 is slid in the X-direction by rotation of the X-direction drive screw 54.

On the X-direction moving stand 52 is a Y-direction moving stand 56 so as to be slidable in a Y-direction (from top to bottom as viewed from FIGS. 9 and 10) through the linear guides 53. A Y-direction drive unit 58 is also secured to the X-direction moving stand 52. The Y-direction drive unit 58 serves to rotate a Y-direction drive screw 57, which extends in the Y-direction and is screwed into the Y-direction moving stand 56. The Y-direction moving stand 56 is slid in the Y-direction by rotation of the Y-direction drive screw 57.

The Y-direction moving stand 56 includes a rotating shaft 59 which stands upright. The rotating shaft 59 mounts a $\theta$-direction drive unit 60 that is rotatable around the rotating shaft 59. The $\theta$-direction drive unit 60 retains a guide shoe 5 and serves to displace the cage 4 in a $\theta$-direction, i.e., in the direction of rotation of the drive unit.

The use of the displacement mechanism thus constructed, allows the cage 4 to be displaced not only in the X- and Y-directions but in the $\theta$-direction as well.

While the external storage unit 12 is used as the storage means in the embodiments of the first to third aspects of the invention, a memory built in the computer 10 may be used as the storage means as long as its capacity is sufficiently large.

While the displacement mechanism 6 is driven at the time of a trial run in the embodiments of the first to third embodiment of the invention, the displacement mechanism 6 may not necessarily be driven at the time of a trial run as long as the error data can be stored in the storage means.

While the encoder is used as the operational state detector 31 in the second embodiment of the present invention, the application of the invention is not limited thereto, but the operational state detector 31 and the position detector may separately be arranged.

While the positional deviation detecting means 20 which detects the positional deviation of the cage 4 in the horizontal direction by transmission of the laser beams in the fourth embodiment of the present invention, the application of the invention is not limited thereto, nor is the number of laser beams used in the above embodiment for irradiation particularly limited. However, if at least two laser beams each above and below the cage 4 are used, positional deviations in the direction of cage rotation, i.e., the out-of-phase condition of each guide rail 2, can be detected.

As described in the foregoing pages, the elevator of the first embodiment of the present invention is so constructed that the displacement mechanism for displacing the cage in the horizontal direction relative to the guide rails is interposed between the cage and the guide shoes, and that the positional deviation of the cage can be corrected by controlling the displacement mechanism by the controller in accordance with data in the storage means, that data corresponding to the detected position of the cage in the ascending/descending direction detected by the position detector. This allows the guide rails to be installed with rough alignment, thereby providing the advantages such as significant reduction in guide rail installation time and the overall elevator installation time, saving in cost, prevention of horizontal oscillation of the cage, and improved quality of ride.

The elevator of the second embodiment of the present invention is so constructed that the displacement mechanism for displacing the cage in the horizontal direction relative to the guide rails is interposed between the cage and the guide shoes, and that any positional deviation of the cage caused by guide rail installation errors is corrected by controlling the displacement mechanism by the controller in accordance with data in the storage means, the data corresponding to an estimated position calculated by the controller that the cage will reach after a predetermined time. This estimated position is calculated from detection data including the position of the cage detected by the position detector and its operational states detected by the operational state detector. In addition to the advantages obtained by the first embodiment of the invention, the elevator of the second embodiment of the invention ensures that the horizontal oscillation can be more effectively prevented, thereby further improving the quality of ride.

The elevator of the third embodiment of the invention is so constructed that the displacement mechanism for displacing the cage in the horizontal direction relative to the guide rails is interposed between the cage and the guide shoes, and that any positional deviation of the cage caused by guide rail installation errors is corrected by controlling the displacement mechanism by the controller in accordance with data in the storage means. The data corresponds to an estimated position calculated by the controller that the cage will reach after a predetermined time. This estimated position is calculated from detection data including the position of the cage detected by the position detector and its operational states detected by the operational state detector. Further, in the elevator of the third embodiment of the present invention, if the rate of change of the displacement mechanism at the estimated position is larger than a present value, then the controller causes the cage to decelerate. Therefore, in addition to the advantages obtained by the second embodiment of the present invention, the horizontal oscillation can be more effectively prevented even if the rate of change in the horizontal displacement of the cage is large, thus further improving the quality of ride.

The elevator of the fourth embodiment of the invention is so constructed that the displacement mechanism for displacing the cage in the horizontal direction relative to the guide rails is interposed between the cage and the guide shoes. A positional deviation detecting means for detecting a positional deviation of the cage in the horizontal direction caused by guide rail installation errors inside the ascending/descending path; is provided and the controller for controlling the displacement mechanism in accordance with the data from the positional detecting means is provided. Therefore, in addition to the advantages obtained by the first aspect of the invention, horizontal oscillation of the cage can be prevented even in the presence of a positional deviation or deformation of the guide rails after their installation.

What is claimed is:

1. A system for reducing horizontal deviations of elevators in which a cage ascends or descends in an ascending/descending path while engaged with guide rails through guide shoes, said system comprising:

displacement means, disposed between the cage and the guide shoes, for displacing the cage relative to the guide rails in a direction perpendicular to a plane of the guide rails and in a direction parallel to the plane of the guide rails, wherein the parallel and perpendicular displacements are independent of each other;

position detecting means for detecting a position of the cage in the ascending/descending path;

storage means for storing error corresponding to guide rail installation errors with respect to positions of said cage in the ascending/descending direction;

control means for controlling said displacement means to correct positional deviations of the cage at a speed corresponding to an ascending/descending speed of the cage in accordance with error data stored in said storage means, the error data corresponding to the position detected by said position detecting means.

2. An elevator as claimed in claim 1, further comprising:

an operational state detecting means for detecting operational states of said cage.

3. An elevator as claimed in claim 2, wherein said control means controls said displacement means to correct positional deviations of said cage in the horizontal direction resulting from said guide rail installation errors in accordance with said error data stored in said storage means, the error data corresponding to an estimated position which is a position reached by the cage after a predetermined time T, the estimated position being calculated by said control means using data including outputs of said operational state detecting means of said position detecting means.

4. An elevator as claimed in claim 3 wherein said control means serves to decelerate said cage when a rate of change of said displacement means at said estimated position is larger than a predetermined value.

5. An elevator as claimed in claim 1, wherein said displacement means includes first displacement mechanism causing said cage to move in a direction perpendicular to a plane of the guide rails and second displacement mechanism causing said cage to move in a direction parallel to the plane of the guide rails.

6. A system as claimed in claim 1 wherein said displacement means includes an angular drive unit which displaces the cage in a direction of rotation about an axis of the ascending/descending path.

7. A system for reducing horizontal deviations of elevators in which a cage ascends or descends in an ascending/descending path while engaged with guide rails through guide shoes, said system comprising:

displacement means, disposed between the cage and the guide shoes, for displacing the cage relative to the guide rails in a direction perpendicular to a plane of the guide rails and in a direction parallel to a plane of the guide rails, wherein the perpendicular and parallel displacement are independent of each other;

a position deviation detecting device which detects positional deviations of the cage having a pair of lasers, one disposed at an uppermost portion of the ascending/descending path and the other disposed at a lower most portion of the ascending/descending path, and having a light receiving device disposed on a ceiling portion of the cage and light receiving device disposed on a lower most portion of the cage, so that the lasers are in optical communication with the light receiving devices; and control means connected to said displacement means and said position deviation device for controlling said displacement means to correct the positional deviation of the cage in accordance with positional deviation data applied from said positional deviation detecting device.

8. An elevator as claimed in claim 7, wherein said displacement means includes a first displacement mechanism causing said cage to move in a direction perpendicular to a plane of the guide rails and a second displacement mechanism causing said cage to move in a direction parallel to a plane of the guide rails, and the second displacement mechanism having a third mechanism retaining the guide shoe and serving to displace the cage in a direction of cage rotation.

9. A system for reducing horizontal deviations of elevators in which a cage ascends or descends in an ascending/descending path while engaged with guide rails through guide shoes, said system comprising:

displacement means, in communication with the guide shoes, for displacing the cage relative to the guide rails in a direction of rotation about an axis of the ascending/descending path;

a position deviation detecting means for detecting positional deviations of the cage in a direction perpendicular to a side of the cage; and control means, connected to said displacement means and said position deviation means, for controlling said displacement means to correct the positional deviations of the cage in accordance with positional deviation data detected by said positional deviation detecting means.

* * * * *